US006776398B1

(12) United States Patent
Tsai

(10) Patent No.: US 6,776,398 B1
(45) Date of Patent: Aug. 17, 2004

(54) BELT POST STRUCTURE

(75) Inventor: Hung Wen Tsai, Taichung (TW)

(73) Assignee: Strong-Way United Co., Ltd., Taichung (TW)

( * ) Notice: Subject to any disclaimer, the term of this patent is extended or adjusted under 35 U.S.C. 154(b) by 0 days.

(21) Appl. No.: 10/352,089

(22) Filed: Jan. 28, 2003

(51) Int. Cl.[7] ..... E04H 17/02

(52) U.S. Cl. ..... 256/45; 256/37; 256/40; 256/43

(58) Field of Search ..... 256/1, 24, 37, 256/39, 40, 43, 45; 160/24

(56) References Cited

U.S. PATENT DOCUMENTS 4,844,420 A * 7/1989 Oster ..... 256/1
6,375,164 B1 * 4/2002 Siegler et al. ..... 256/1
6,532,903 B2 * 3/2003 Prusia et al. ..... 119/792

* cited by examiner

*Primary Examiner*—Lynne H. Browne
*Assistant Examiner*—Victor MacArthur
(74) *Attorney, Agent, or Firm*—Rosenberg, Klein & Lee

(57) ABSTRACT

A belt post includes a post with a box on a top of the post and a reel of belt is received in the box. A spring box is engaged with the top of the box and the mandrel of the reel is engaged with the spring. A head assembly is connected to a distal end of the belt and includes a movable piece which is retractably received in a body with a spring biased therebetween. The head assembly is easily to be engaged between a top cap and a bottom cap of another box by pushing the movable piece to change the length the combination of the body and the movable piece.

5 Claims, 8 Drawing Sheets

BELT POST STRUCTURE

FIELD OF THE INVENTION

The present invention relates to a belt post structure wherein the belt is connected to a coil spring and can be easily engaged with another post.

BACKGROUND OF THE INVENTION

A conventional barrier device is shown FIG. 7 and generally includes two posts 61 and each post 61 has a base 62 so as to be able to stand on a surface. A flange 63 is connected to a top of each of the posts 61 and has a plurality of holes 631 defined therethrough. A decoration sphere 64 is connected on the flange 63. A wire 65 has two hooks 651 connected to two ends of the wire 65 so that the hooks 651 are engaged with one of the holes 631 of the two flanges 63. The distance between the two posts 61 cannot be too wide because the wire 65 has a fixed length. The distance between the posts 61 cannot be too short because the wire 65 may then droop and touch the ground.

The present invention intends to provide a belt post assembly that has two posts and a belt is connected to a coil spring. A head assembly is connected to the belt so that the head assembly can be engaged with another post conveniently.

SUMMARY OF THE INVENTION

In accordance with one aspect of the present invention, there is provided a belt post assembly which comprises two posts and a box is connected to each of the two posts. Each box includes a lower race fixedly connected to the post and having a first skirt portion. A receiving member has an end fixedly inserted in the lower race and has a slot. A reel of belt is received in the receiving member and includes a mandrel which has an engaging port on a top end of the mandrel so as to connect to an end of a coil spring. The coil spring is received in a spring box which is engaged in the receiving member. An top cover is fixedly mounted to the receiving member and has a second skirt portion.

A head assembly is fixedly connected to a leading end of the belt and includes a body and a movable piece is movably received in the body from a lower end of the body. The body has a first lug and the movable piece has a second lug. The first lug is engaged with a gap between the first skirt portion and an outside of the receiving member. The second lug is engaged with a gap between the second skirt portion and the outside of the receiving member.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
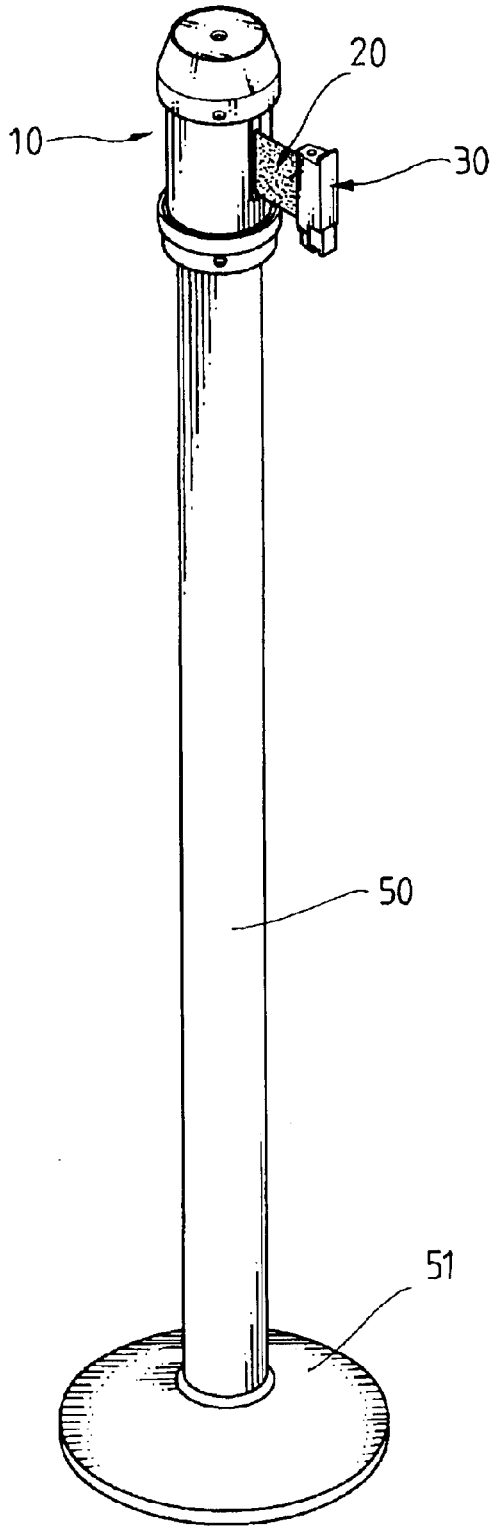
FIG. 1 is a perspective view to show one of two posts of the belt post assembly of the present invention.
Figure 2:
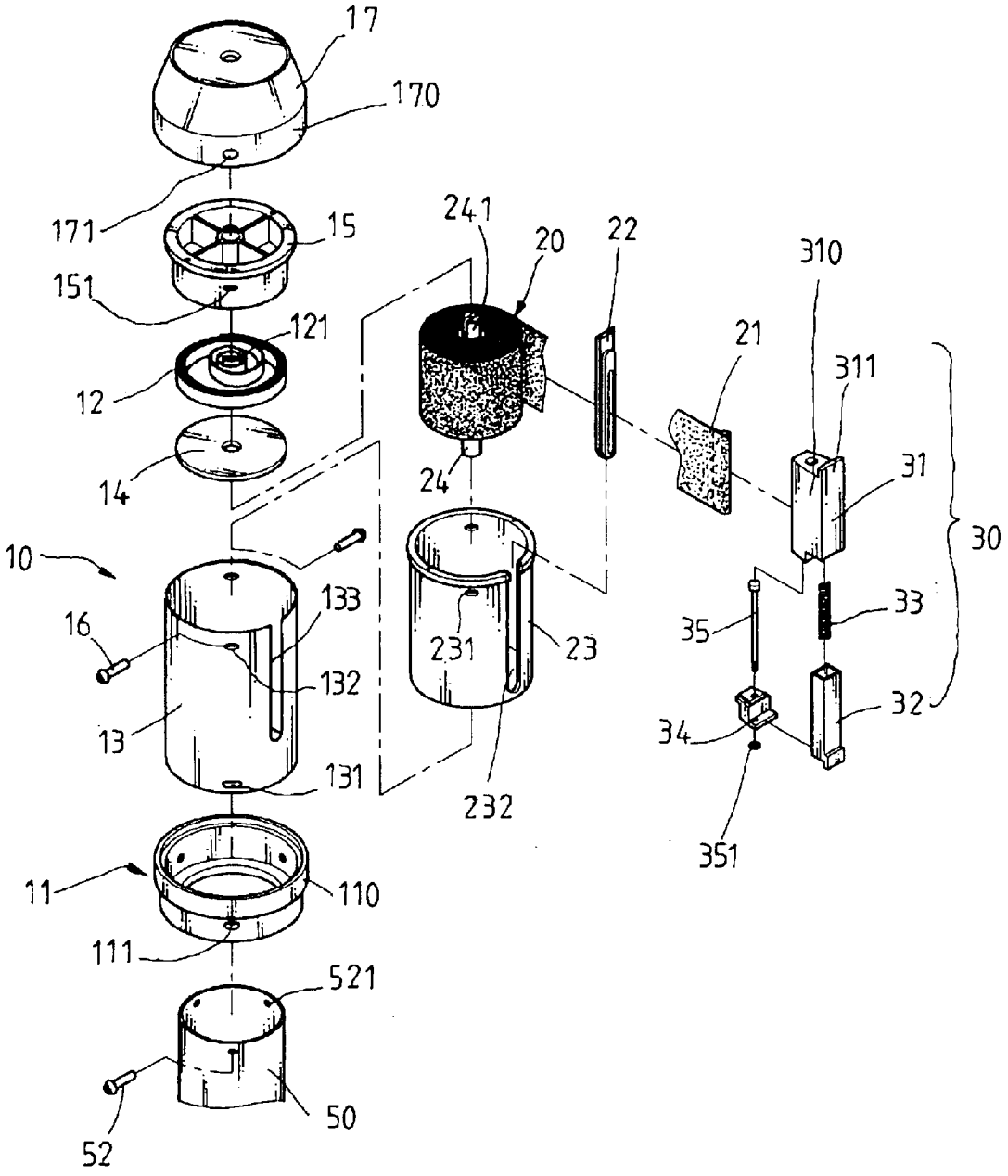
FIG. 2 is an exploded view to show the box and the head assembly of the belt post assembly of the present invention.

Referring to FIGS. 1 and 2, the belt post assembly of the present invention comprises two posts 50 and a base 51 is connected to a lower end of each post 50. A box 10 is connected to a top end of each of the two posts 50. Each box 10 includes a lower race 11 which is fixedly connected to the post 50. A first skirt portion 110 extends from a top open end of the lower race 10. A receiving member 13 has an end fixedly inserted in the lower race 11 by extending screws 52 through holes 521 through the wall of the post 50, the slots 111 in the lower race 11 and the slots 131 in the receiving member 13. A first slot 133 is defined through the wall of the receiving member 13. A casing 23 is received in the receiving member 13 and has a second slot 232 which is located in alignment with the first slot 133. A reel the belt 20 is received in the casing 23 and the leading end 21 of the belt 20 extends through the aligned first slot 133 and the second slot 232. The reel of belt 21 includes a mandrel 24 and an engaging port 241 is defined in a top end of the mandrel 24. The engaging port 241 is connected to an end 121 of a coil spring 12. A separation plate 14 is located between the reel of belt 20 and the coil spring 12 so as to prevent friction between the two items. The coil spring 12 is received in a spring box 15 which is engaged in the receiving member 13. A top cover 17 is fixedly mounted to the receiving member 13 and screws 16 extend through the slots 171 in the top cover 17, the slots 151 in the spring box 15, the slots 231 in the casing 23 and the slots 132 in the receiving member 13. The top cover 17 has a second skirt portion 170.

A head assembly 30 is fixedly connected to a leading end 21 of the belt 20 and includes a body 31 and a movable piece 32 movably received in the body 31 from a lower end of the body 31. The body 31 has an opening 310 through which the leading end 21 having a loop portion is inserted. A bolt 35 extends through the body 31 and the loop portion of the leading end 21 of the belt 20. An end piece 34 is connected to the body 31 and the bolt 35 extends through the end piece 34, and is connected to a nut 351 so that the leading end 21 of the belt 20 is connected to the body 31.

The body 31 has a first lug 311 extending from a top thereof, and the movable piece 32 has a second lug 321 extending from a lower end thereof. A spring 33 is received in the body 31 and biased between an inside of the body 31 and an end of the movable piece 32. Therefore, the movable piece 32 can be pushed into the body 31 to shorten the width between the first lug 311 and the second lug 321.

Figure 3A:
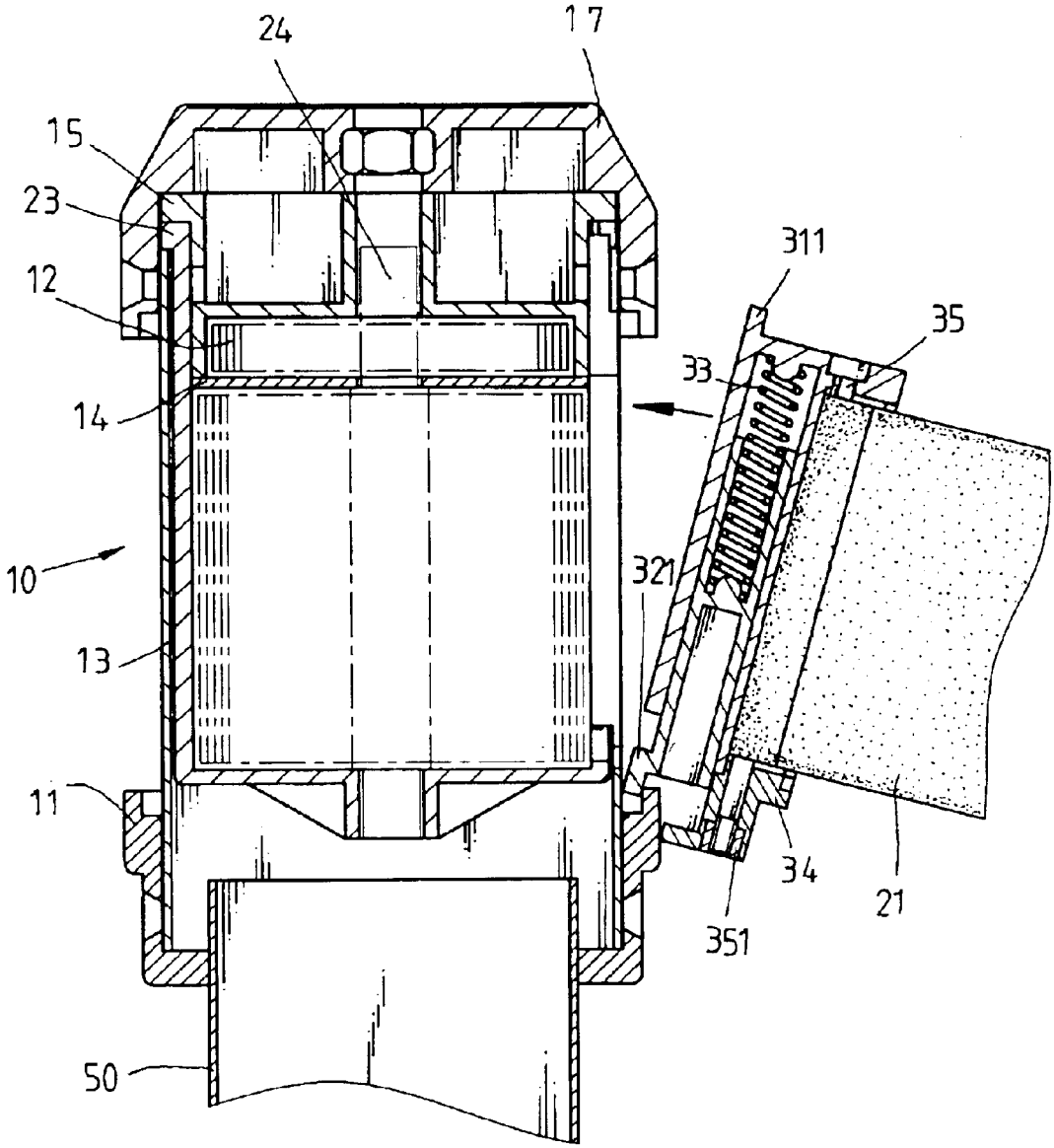
FIG. 3A shows how the lug is engaged with the gap between the first skirt portion and the receiving member.
Figure 3B:
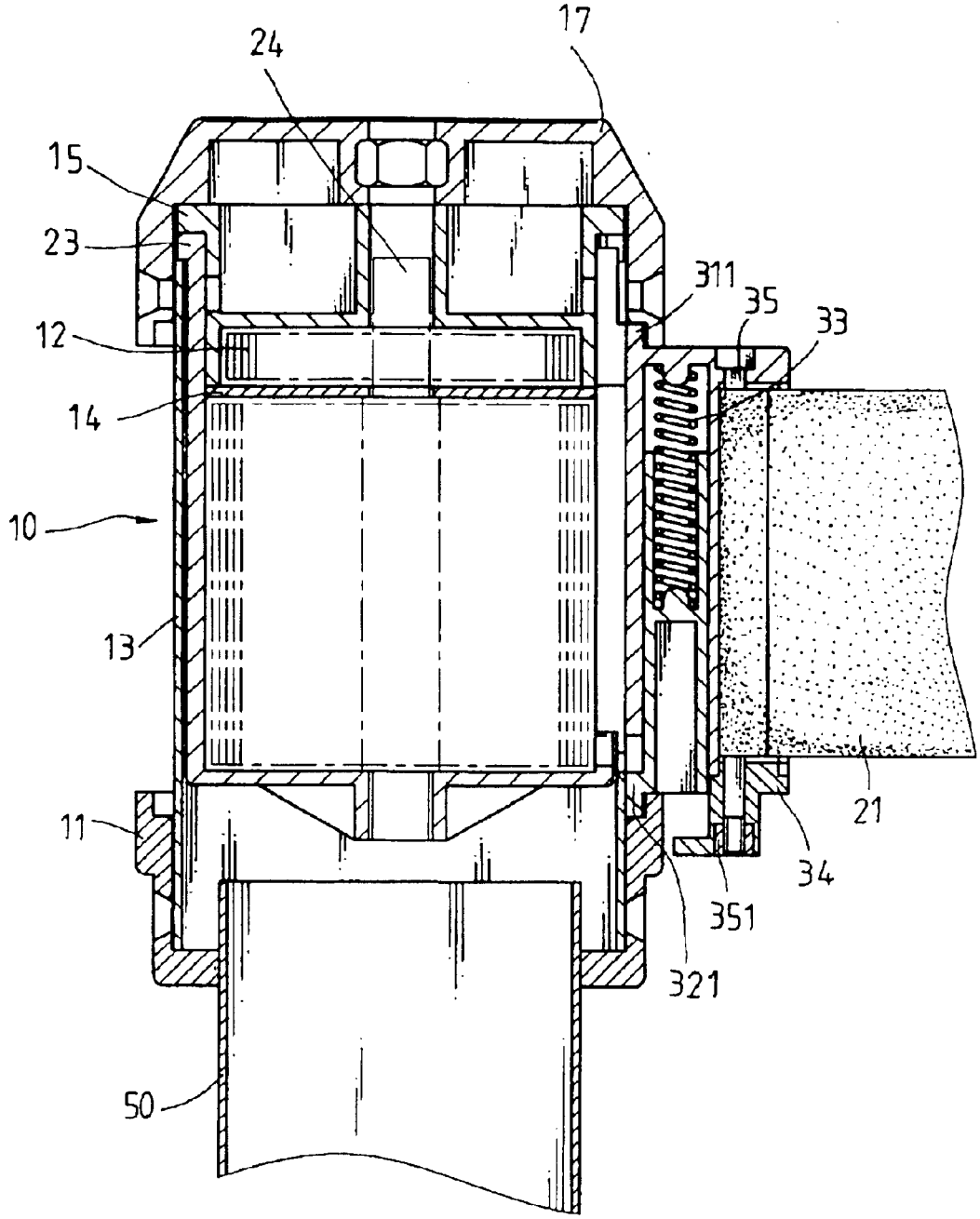
FIG. 3*b* shows the other lug is engaged with the gap between the second skirt portion and the receiving member.

As shown in FIGS. 3A and 3B, the second lug 321 can be engaged with a gap between the second skirt portion 170 and the outside of the receiving member 13 simply by pushing the movable piece 32. The first lug 311 can then be engaged with a gap between the first skirt portion 110 and an outside of the receiving member 13 while the movable piece 32 is compressed.

Figure 4:
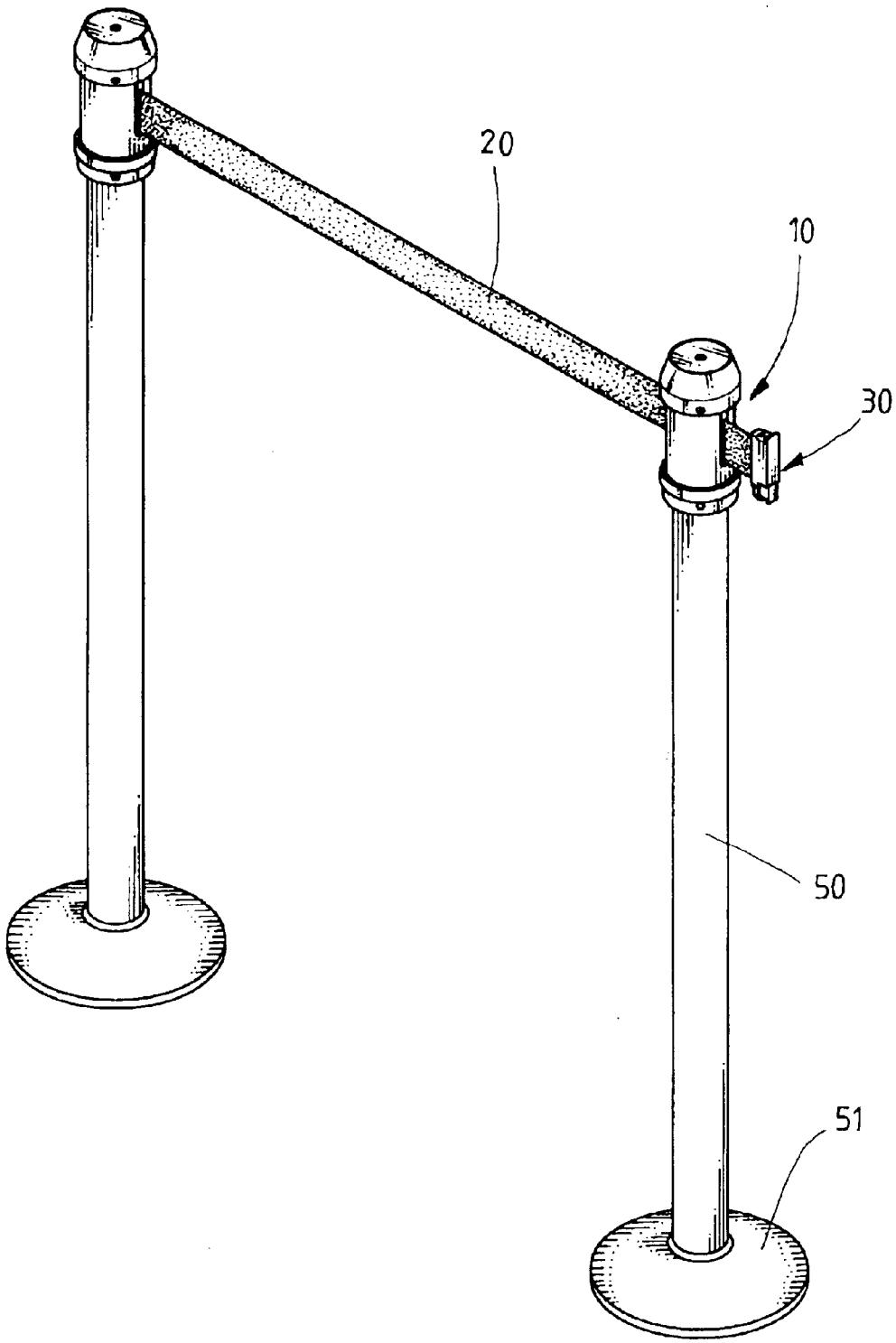
FIG. 4 shows the belt may extend through the box on a second post and is led to a third post which is not shown.
Figure 5:
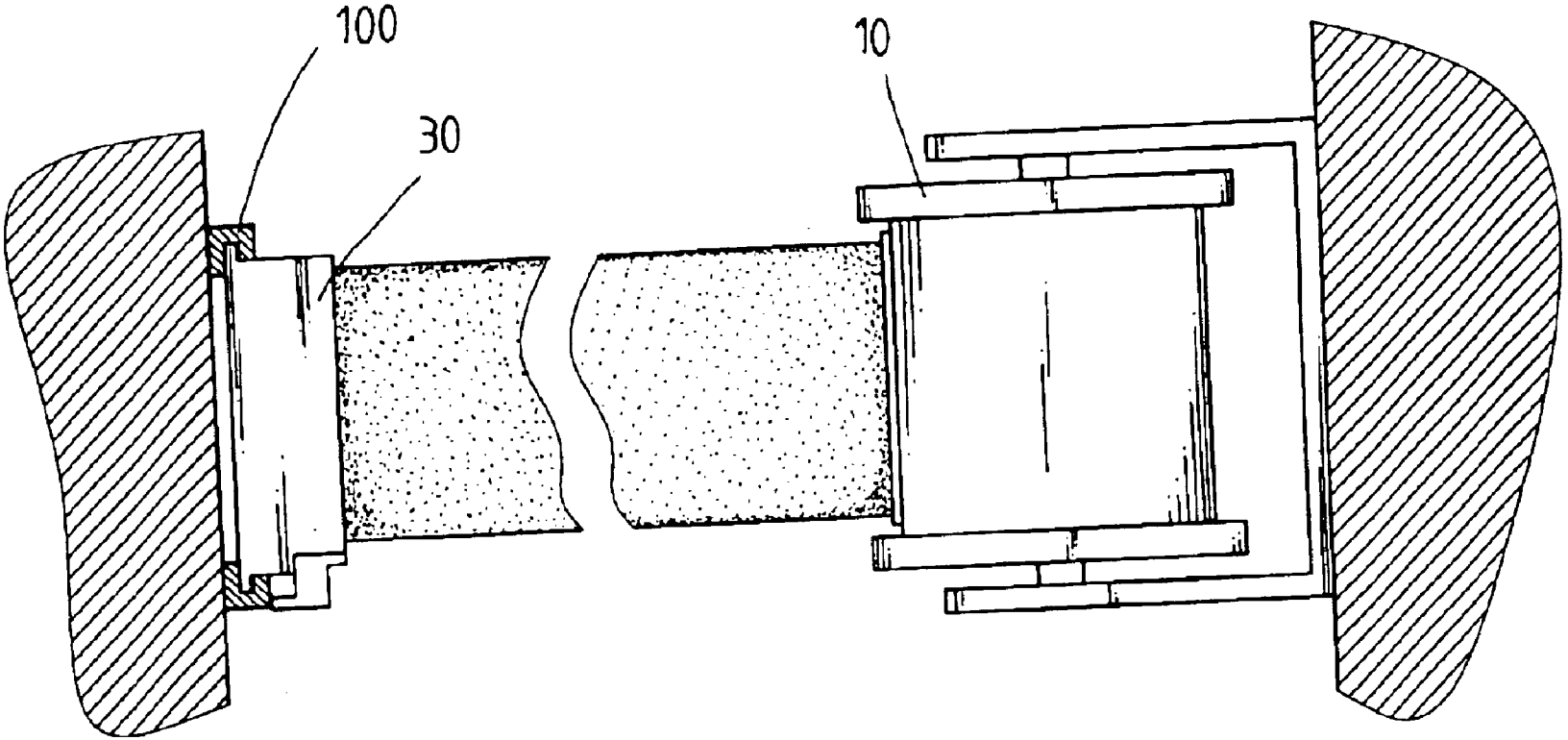
FIG. 5 shows the skirt portions can be made individually.
Figure 6:
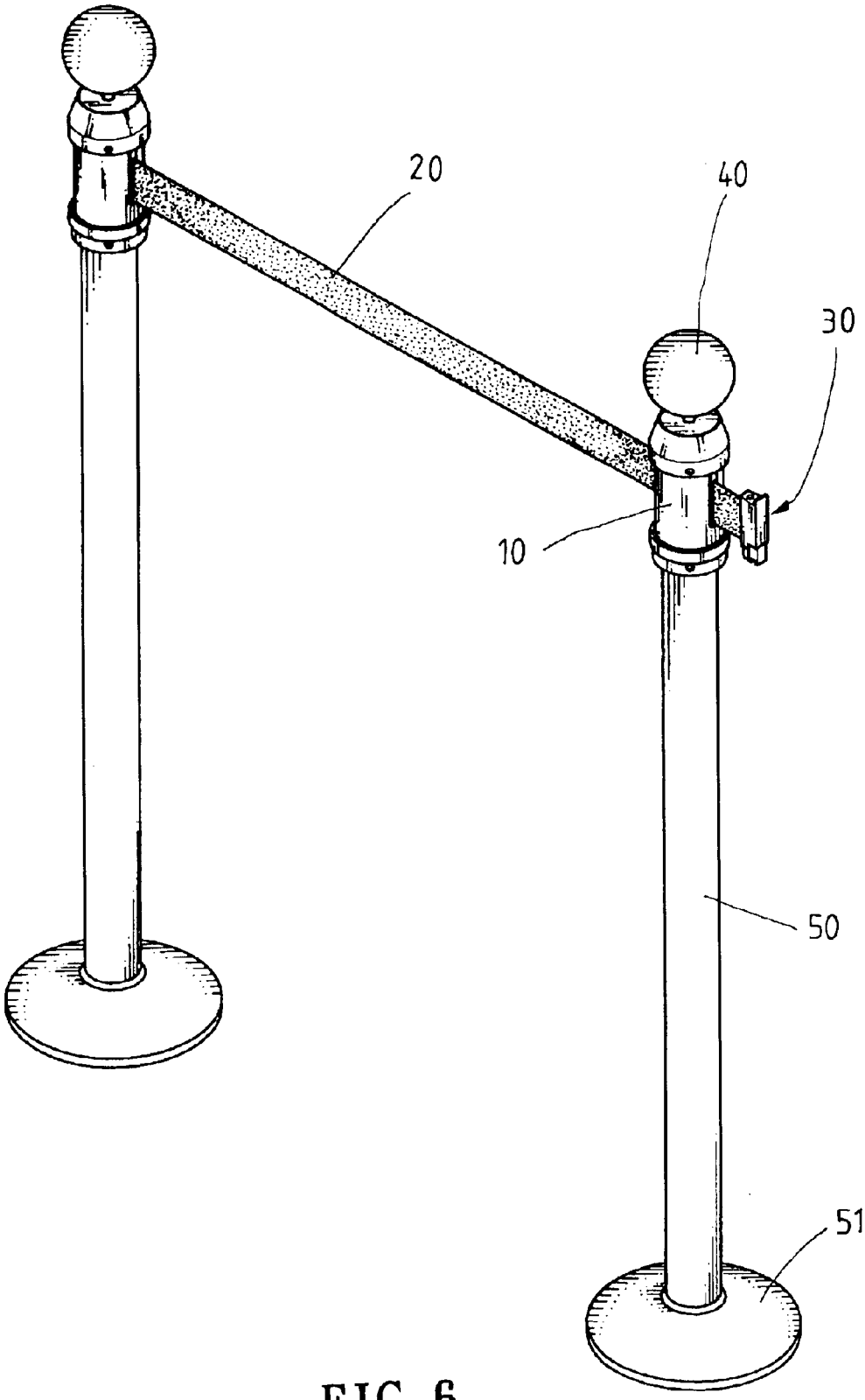
FIG. 6 shows decoration spheres are connected on the two posts.
Figure 7:
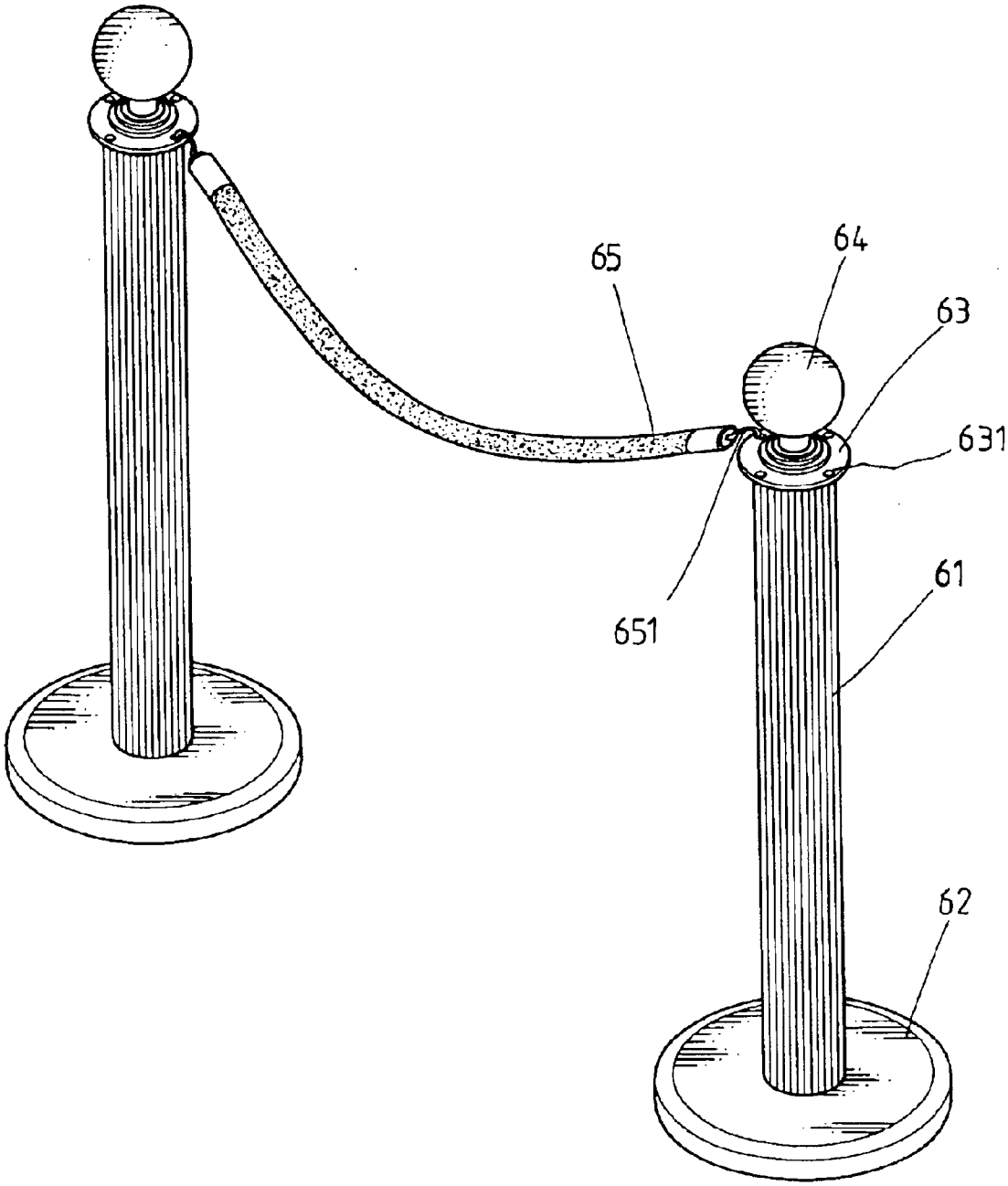
FIG. 7 PRIOR ART
FIG. 7 shows a conventional belt post assembly.

FIGS. 4 and 5 show that the belt 20 can be extended through the head assembly 30 on a second post 50 to be engaged with a head assembly 30 on a third post 50 which is not shown. Each post 50 may also have a decoration sphere 40.

FIG. 5 shows that the first skirt portion and the second skirt portion can be replaced by an individual member 100 for being engaged with the head assembly 30.

While we have shown and described the embodiment in accordance with the present invention, it should be clear to those skilled in the art that further embodiments may be made without departing from the scope of the present invention.

What is claimed is:

1. A belt post assembly comprising:

at least two posts each having a box connected thereto, each box including a lower race which is fixedly connected to the post and has a first skirt portion extending from a top open end of the lower race, a receiving member having an end fixedly inserted in the lower race and having a first slot, a reel of belt received in the receiving member and including a mandrel, an engaging port on a top end of the mandrel and connected to an end of a coil spring, the coil spring received in a spring box engaging the receiving member, a top cover fixedly mounted to the receiving member and having a second skirt portion, the first and second skirt portions being axially offset one from the other and protruding radially relative to an outside surface of the receiving member;

at least a first of the boxes further including a head assembly fixedly connected to a leading end of the belt for detachable connection to a second of the boxes, the head assembly including a body, a movable piece movably coupled to a lower end of the body, the body having a first lug and the movable piece having a second lug, when the head assembly is detachably connected to the second box, the first and second lugs respectively engaging gaps defined by the first and second skirt portions against the outside surface of the receiving member, whereby the body is retained against the outside surface of the receiving member to extend axially therealong.

2. The belt post assembly as claimed in claim 1, wherein a casing is received in the receiving member of each box, the casing having a second slot which is located in alignment with the first slot, the reel of belt being received in the casing, the leading end extending through the aligned first slot and the second slot.

3. The belt post assembly as claimed in claim 1, wherein the body has an opening through which the leading end having a loop portion is inserted, a bolt extending through the body and the loop portion of the leading end of the belt.

4. The belt post assembly as claimed in claim 1 further comprising a spring received in the body and biased between an inside of the body and an end of the movable piece.

5. The belt post assembly as claimed in claim 3 further comprising an end piece connected to the body, the bolt extending through the end piece, the bolt having a nut connected thereto.

* * * * *